US006641139B2

(12) United States Patent
Lamberti et al.

(10) Patent No.: US 6,641,139 B2
(45) Date of Patent: Nov. 4, 2003

(54) GAME ENCLOSURE

(75) Inventors: Catherine B. Lamberti, Santa Barbara, CA (US); Timothy J. Osbaldeston, Ventura, CA (US)

(73) Assignee: Sportwall International, Inc., Carpinteria, CA (US)

( * ) Notice: Subject to any disclaimer, the term of this patent is extended or adjusted under 35 U.S.C. 154(b) by 0 days.

(21) Appl. No.: 10/080,857

(22) Filed: Feb. 22, 2002

(65) Prior Publication Data

US 2003/0160390 A1 Aug. 28, 2003

(51) Int. Cl.[7] ..... A41J 5/04; A63C 19/00
(52) U.S. Cl. ..... 273/378; 472/94; 273/348
(58) Field of Search ..... 273/348, 371–402; 472/92, 94, 136

(56) References Cited

U.S. PATENT DOCUMENTS 1,303,494 A * 5/1919 Nichols ..... 273/386
1,316,792 A * 9/1919 Hanson ..... 273/375
3,802,705 A * 4/1974 Burns et al. ..... 273/357
4,279,414 A * 7/1981 Kammerman et al. ..... 472/94
4,392,652 A * 7/1983 Knight et al. ..... 273/358
4,941,662 A * 7/1990 DePerna ..... 273/317.6
4,962,935 A * 10/1990 Williams ..... 473/474
5,556,106 A * 9/1996 Jurcisin ..... 473/431
6,174,242 B1 * 1/2001 Briggs et al. ..... 472/136

FOREIGN PATENT DOCUMENTS

JP 5-245248 * 5/1993

* cited by examiner

*Primary Examiner*—Mark S. Graham
(74) *Attorney, Agent, or Firm*—Jack C. Munro

(57) ABSTRACT

A game enclosure which utilizes an enclosing wall essentially enclosing an internal chamber with the internal chamber also be further closed by a ceiling and a floor. An electronic scoring panel is mounted in conjunction with the enclosing wall. The electronic scoring panel includes a series of targets with there also being targets mounted on the enclosing wall. When a human player within the internal chamber throws a ball which contacts one of the targets, a scoring number will be added to a scoring display area located on the scoring panel.

11 Claims, 2 Drawing Sheets

GAME ENCLOSURE

BACKGROUND OF THE INVENTION

1. Field of the Invention

The field of this invention relates to games and more particularly to a game enclosure that is designed to be utilized by humans in the playing of scoring type of games.

2. Description of the Related Art

Rebound walls for ball sports have been known. The present inventor has previously filed U.S. patent application Ser. No. 09/643,394 on Aug. 22, 2000 entitled, REBOUND WALL FOR BALL SPORTS. The subject matter of this prior application relates to the arranging of several panels in a side-by-side manner which are to function to rebound a ball that strikes the panel back toward the player. Each of the panels are electronically operated and include sensors to detect a ball striking a target area which then accumulates a score value in a scoring display area. Normally, the panels will also include audio to be heard by the player. A panel, similar to what was submitted in the prior application, is designed to be incorporated in conjunction with the subject invention. For a more detailed description of the electronic features of such a panel, reference is to be had to the prior application.

The use of game enclosures has long been known. A typical game enclosure would be a handball court or a racquetball court. These types of courts utilize an enclosing wall structure composed of four planar walls arranged in a box-like configuration, a planar ceiling and a planar floor. The handball or the racquetball is propelled around inside the enclosure and the appropriate handball game or racquetball game is played by a player relative to an opponent or a pair of players to a pair of opponents. The ball that is used in handball is less than two inches in diameter and is constructed of hard rubber. The ball used in racquetball is a little larger than two inches in diameter and is substantially softer.

Previous to the present invention, it is believed by the inventors that it has not been known to incorporate a game enclosure similar to a handball court or a racquetball court in conjunction with a building or room which is designed to be utilized by young children in the playing of a scoring game.

SUMMARY OF THE INVENTION

A basic embodiment of the present invention which comprises a game enclosure forming an enclosing wall arrangement which is closed by a ceiling and a floor which forms an internal chamber. Human players are to be located within the internal chamber and move about on the floor. The enclosing wall arrangement includes an electronic scoring panel which is accessible from within the internal chamber. An electronic scoring panel has a scoring display area adapted to display a scoring value. The electronic scoring panel also has a plurality of spaced-apart panel targets. These panel targets are connected electronically to the display area. A plurality of wall targets are also mounted on the enclosing wall arrangement. Each wall target is also electrically connected to the display area of the electronic scoring panel. As a human throws a ball against either a panel target or a wall target from within the internal chamber, a scoring number will be added to the scoring value of the display area.

A further embodiment of this invention is where the basic embodiment is modified by the enclosing wall arrangement being formed of a series of planar panels.

A further embodiment of the present invention is where the basic embodiment is modified by the enclosing wall arrangement being in the shape of a rectangular box.

A further embodiment of the present invention is where the embodiment is modified by the enclosing wall arrangement being substantially transparent.

A further embodiment of the present invention is where the basic embodiment is modified by the there being at least one wall target mounted on the ceiling.

A further embodiment of the present invention is where the basic embodiment is modified by there also being included a timer display area to display a time value for the playing of a selected game.

A further embodiment of the present invention is where the basic embodiment is modified by the enclosing wall arrangement including a net or screen in order to facilitate the entrance of air within the internal chamber.

A further embodiment of the present invention is where the basic embodiment is modified by the enclosing wall arrangement also including a door in order to permit entry and exit of humans from within the internal chamber.

A further embodiment of the present invention is where the basic embodiment is modified by each of the panel targets and the wall targets being constructed to include a series of illuminatable lights.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
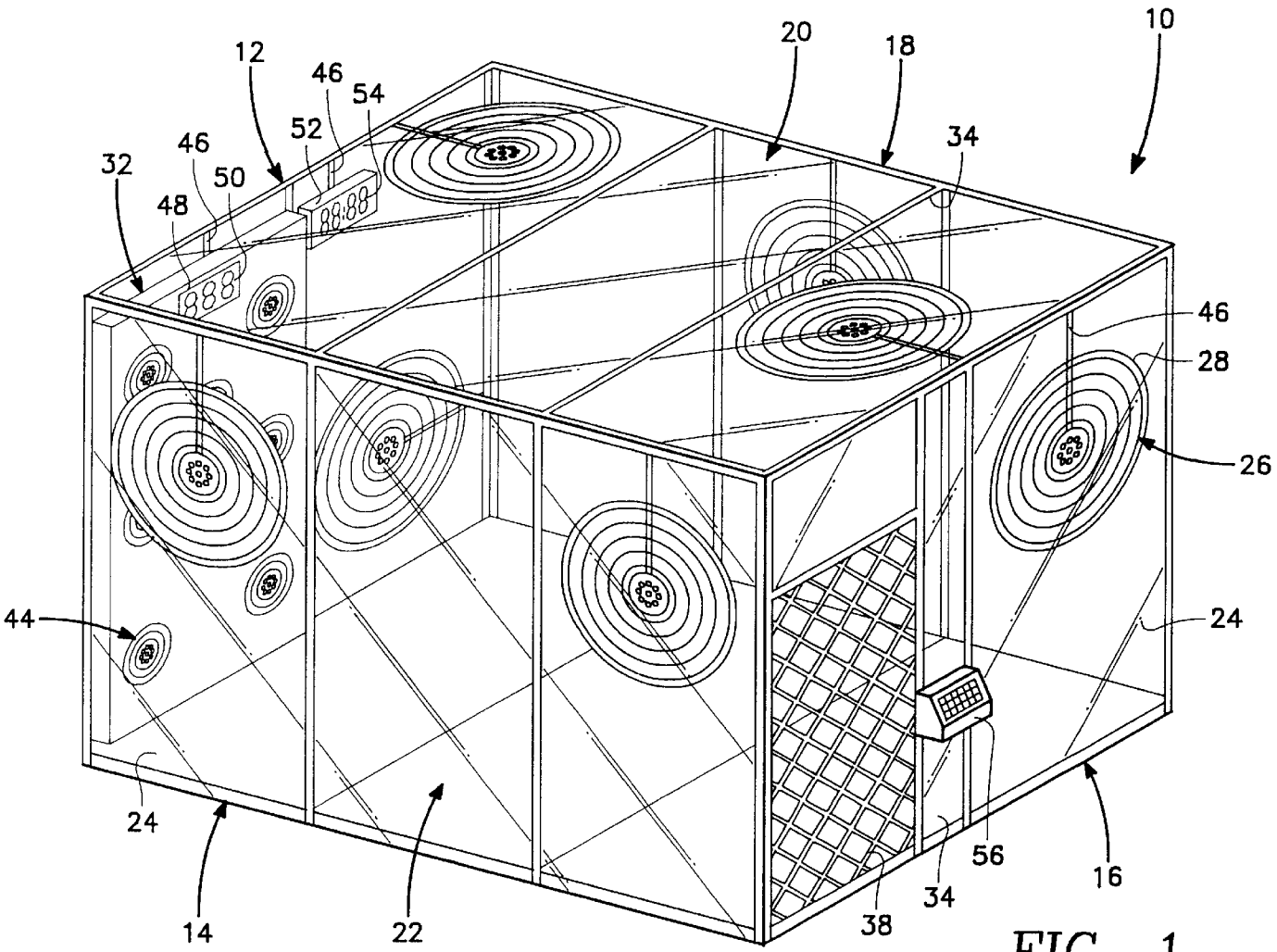
FIG. 1 is an exterior isometric view of the game enclosure of the present invention.

Referring particularly to FIG. 1, there is shown the game enclosure 10 of this invention which is formed of an enclosing wall arrangement defined as a front wall 12, a left sidewall 14, a back wall 16 and a right sidewall 18. The height of each of the walls 12, 13, 16 and 18 are all identical and are to be closed of by a ceiling 20. The walls 12, 14, 16 and 18 are mounted to assume a vertical configuration extending from a floor 22. Each of the walls 12, 14, 16 and 18, ceiling 20 and floor 22 are to be constructed of a series of planar panels 24. Each of the planar panels 24 will normally be substantially transparent and will normally comprise plastic. However, glass could be used. Formed on some of the panels is a wall target 26. The wall target 26 will include a series of concentric rings 28 which will normally be painted or otherwise permanently applied onto the panel 24. Instead of rings 28, any other symbol representation could be used. Centrally mounted within each wall target 26 is a series of lights 30. Typically, there will be utilized sixteen in number of lights 30. However, this number could be increased or decreased without departing from the scope of this invention. The lights 30 could actually be LED's or light bulbs with the illumination of such to be controlled by an electronic scoring panel 32. The back end of the lights 30 will normally be closed by a cover, which is not shown, in order to represent the invention more clearly in the drawings. The electronic scoring panel 32 is shown mounted within internal chamber 34 of the game enclosure 10.

Access into the internal chamber 34 is to be achieved through a door 36. The door 36 may also include an open mesh area in the form of a net or screen 38. The purpose of the net or screen 38 is to provide entry of air to the internal chamber 34. However, the net or screen 38 could be eliminated in an appropriate ventilation system included, which is not shown. Also, it is possible that instead of the net or screen 38 only being included in the door 38, it may be that an entire wall, such as the right sidewall 18, could be constructed of net.

Figure 4:
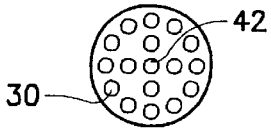
FIG. 4 is a view of the group of illuminatable lights which are contained at the center of each target depicting all lights being illuminated.

The lights 30 are shown to be sixteen in number, as previously mentioned. Typically, when starting into play of a particular game, all the individual lights making up the lights 30 will be lit (see FIG. 4), which means all sixteen will be illuminated. When a human, which may be a child, is located within the internal chamber 34 and throws ball 40 which comes into contact or in close proximity to a wall target 26, the lights 30 of that particular wall target 26 will no longer be illuminated. Associated with each target 25 is an piezoelectric transducer, which is not shown. There are available numerous different types of piezoelectric transducers by different manufacturers. One desirable such transducer is manufactured by Radio Shack, Inc., Part No. 900-1401. Also, any desirable form of shock-type sensor could be utilized.

Figure 5:
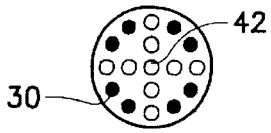
FIG. 5 is a view similar to FIG. 4 showing a lesser number of lights being illuminated.
Figure 6:
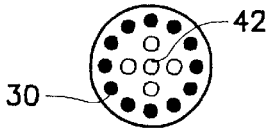
FIG. 6 is a view similar to FIG. 5 showing a still lesser number of the lights being illuminated.
Figure 7:
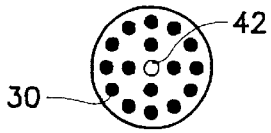
FIG. 7 is a view similar to FIG. 6 showing only a single light being illuminated.

Let it be assumed that in playing of the particular game that the human has not struck that particular target 26 with a ball. After a few seconds, some of the lights of lights 30 will be turned off leaving, for example, only eight of the lights illuminated (see FIG. 5 where the non-illuminated lights are shown as a solid circle). If the target 26 is still not struck with the ball 40, then a few more lights, such as four more lights, will no longer be illuminated (see FIG. 6). If the target 26 is still not struck with the ball 40, then after a few more seconds there might remain only the center light 42 illuminated (see FIG. 7). This illuminating and deluminating pattern of lights is deemed to be strictly a matter of choice and need not be adhered to specifically according to this invention.

The scoring panel 32 also includes a series of panel targets 44. Each of the panel targets 44 are basically painted or otherwise inscribed on the scoring panel 32. At the center of each panel target 44 is the same series of lights 30. The illuminating and deluminating of the lights 30 is to be accomplished in the same manner as was previously discussed in relation to the wall targets 26.

Figure 2:
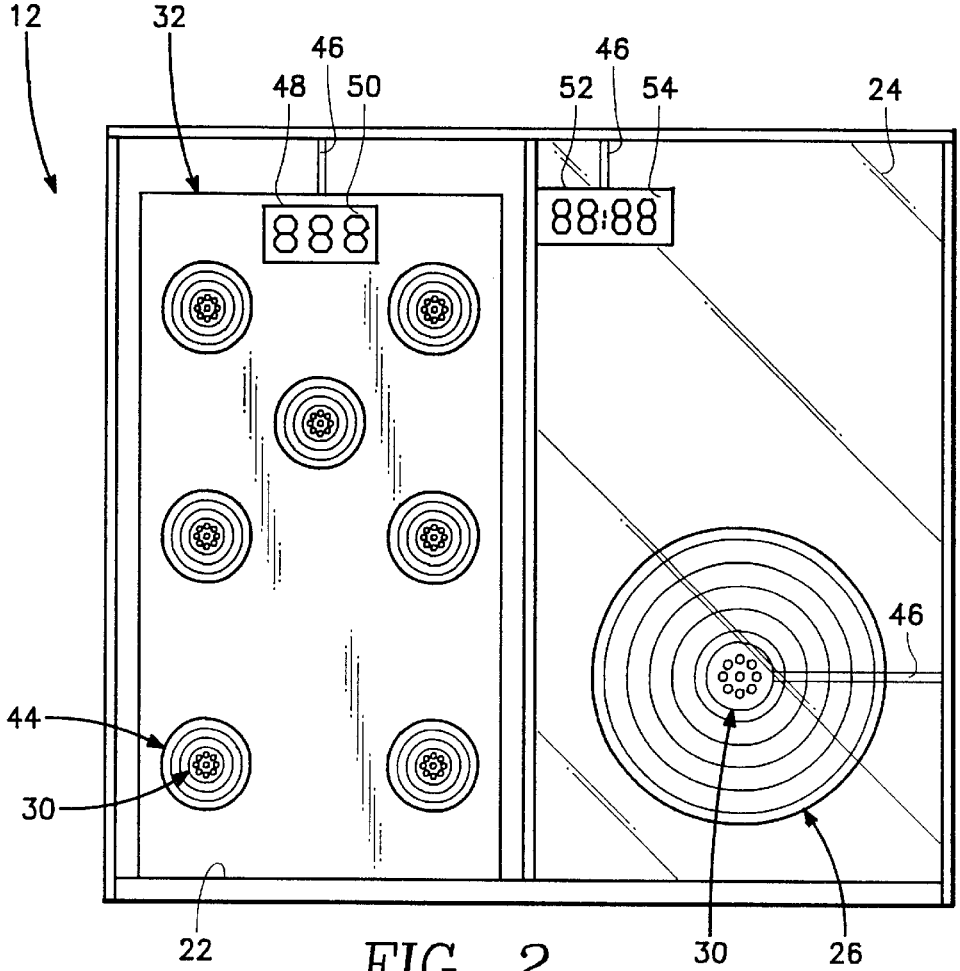
FIG. 2 is a frontal view of l;the front side of the game enclosure of the present invention which includes the electronic scoring panel and also showing a wall target which is connected to the scoring display included within the electronic scoring panel.
Figure 3:
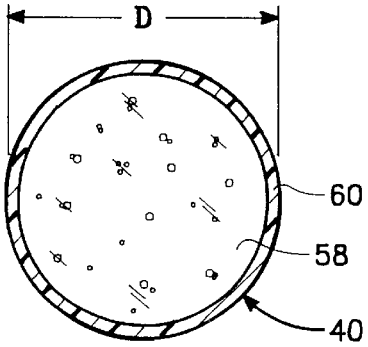
FIG. 3 is a cross-sectional view of a typical ball that is intended to be used in conjunction with the game enclosure of the present invention.

Each of the series of lights 30 in conjunction with each wall target 26 is to be electrically connected by an electrical conductor 46 to the scoring panel 32. The electronics within the scoring panel 32 will be used to drive a display area 48 within which there is to be displayed a scoring value So. It is to be understood that a predetermined scoring value 50 will be assigned that when a target 26 or 44 is struck which will then be added onto the scoring value 50. Generally, there will be a period of time that will be assigned for the playing of a particular game. The amount of time that remains will be displayed within a separate time display area 52 where the time value 54 is shown. The time display area 52 may be included in conjunction with the scoring panel 32 or will be located separate from the scoring panel. 32, as is shown in FIG. 2 of the drawings.

There may be provided on the door 34 an activation box 56 which must be activated by the players when entering of the internal chamber 34 so that the scoring panel 32 will be activated as well as the timer display area 52.

It is to be understood that the walls 12, 14, 16 and 18 are mounted in an edge abutting arrangement. Also, the ceiling 20 will be composed of a series of panels located in an edge abutting arrangement. Typically, each of the panels 24 will be about four feet wide and eight feet tall. Also, typically, the panels 24 will be constructed identically with the exception that some of the panels 24 might not include a wall target 26. Although there are shown three in number of the panels 24 within the left sidewall 14 and the right sidewall 18, it is to be understood that that number could be increased or decreased without departing from the scope of this invention. The same is true for the front wall 12 which only shows one of the panels 24 and the scoring panel 32. However, the front wall 12 could be constructed to include two of the panels 24 which are separated by the scoring panel 32. The back wall 16 includes the door 34 and one panel 24. However, an additional panel 24 could be used which would make the internal chamber of a larger width.

Although it is intended that the ball 40 that is to be used will be constructed of a diameter of between six and eight inches and will be principally constructed of a foam center 58 covered by a plastic outer cover 60. It is to be considered within the scope of this invention that another type of ball may be used in conjunction with the game enclosure. The particular advantage of using the ball 40 is that it is soft and if it happens to strike a player that it will not cause injury.

Within the scoring panel 32, there are provisions for setting its sensitivity. This means that in some games that it is required for the ball 40 to strike precisely the center of its respective target 26 or 44 or the sensitivity could be decreased to the point to where the score will be recorded if the ball 40 strikes even the outermost of the rings 28 of a target.

It is to be understood that a player will be able to choose one of several interactive, skill enhancement games from a menu of preprogrammed electronic games within the scoring panel 32. In addition, the player could regulate the skill level and score performance to be commensurate with his or her own level. It is the intention for the game enclosure of the present invention to provide mental and body fitness for children. The game enclosure 10 is a health clubs answer for fitness training for kids and a new way to encourage kids to exercise. Kids exercise best when they play, where fitness is a consequence of entertainment rather than a discipline in itself. It has been recently published that over fifty percent of the youth in America are obese.

The scoring panel 32 will include a computer system that will be loaded with up to ten different computer games each designed to develop cardiovascular fitness, neuromuscular control, endurance, strength, footwork, ball control, reaction skills and hand/eye foot coordination. Stepping into the game enclosure 10 is like stepping inside a computer. Players will be surrounded on all sides by lighted targets 26 and 44. Music and instructions set the atmosphere and the pace of the game. From one to ten players can play by throwing, striking or kicking of the ball 40 at the illuminated targets 26 and 44. The faster and more accurate the shots of the ball 40, the more points are earned and are recorded in the scoring area 48.

There are numerous different types of games that, of course, can be programmed into the scoring panel 32. One of the games that have been selected is called "Chase the Target". The object is to score as many points as possible in a given length of time. The number of points applied to the score depends on the length of time it takes to hit each target 26 or 44. The faster the ball reaches the particular target, the more points that are earned. Generally, after a certain period of time, such as two seconds, each target starts to shrink, that is instead of sixteen lights being illuminated they will decrease to eight lights being illuminated. A fully illuminated target that will earn five points, a target with eight lights illuminated will earn four points. If the target only has four lights illuminated, then it will earn only three points. If there is only one light illuminated, then it will only earn two points. If there are no lights illuminated, then it will earn zero points. Multiple players with multiple balls 40 can play concurrently and all can be engaged in proceeding to knocking out whatever lights are illuminated on whatever targets 26 and 44. Some games may not require a scoring value 50. The ascertaining of "winning" can be achieved solely by use of an audio or visual representation.

What is claimed is:

1. A game enclosure comprising an enclosing wall arrangement being closed by a ceiling and a floor forming an internal chamber, when used by a human player the player stands on said floor with said ceiling being above and spaced from the player;

an electronic scoring panel mounted in conjunction with said enclosing wall arrangement and being accessible from within said internal chamber, said electronic scoring panel having a means for ascertaining how a player is playing a game, said electronic scoring panel having a plurality of panel targets located spaced apart, said panel targets being connected to said display area; and a plurality of wall targets mounted on said enclosing wall arrangement, each said wall target being electrically connected to said display area of said electronic scoring panel, whereby as a player throws a ball against either a panel target or a wall target that a representation will be generated by said means and communicated to the player giving an indication of how the player is playing the game.

2. The game enclosure as defined in claim 1 wherein:

said enclosing wall arrangement comprises a series of planar panels.

3. The game enclosure as defined in claim 1 wherein:

said enclosing wall arrangement being in the shape of a rectangular box.

4. The game enclosure as defined in claim 1 wherein:

said enclosing wall arrangement being substantially transparent.

5. The game enclosure as defined in claim 1 wherein:

there being at least one said wall target mounted on said ceiling.

6. The game enclosure as defined in claim 1 wherein:

there being a timing display area associated with said game enclosure, said timing display area to be readable by occupants of said internal chamber in order to ascertain the length of time that has lapsed during playing of a game within said internal chamber.

7. The game enclosure as defined in claim 1 wherein:

said enclosing wall arrangement includes a door which permits entry and exit of humans from within said internal chamber.

8. The game enclosure as defined in claim 1 wherein:

at least some portion of said enclosing wall arrangement being closed by means of a screen or net to permit entry of air within said internal chamber.

9. The game enclosure as defined in claim 1 wherein:

each said wall target comprising a series of illuminatable lights.

10. The game enclosure as defined in claim 1 wherein:

said means comprising an auditory representation.

11. The game enclosure as defined in claim 1 wherein:

said means comprising a visual representation.

* * * * *